US012747547B2

(12) United States Patent
Bach et al.

(10) Patent No.: US 12,747,547 B2
(45) Date of Patent: Sep. 29, 2026

(54) PREDOMINANTLY ELECTRICALLY OPERATED EARTH WORKING MACHINE

(71) Applicant: Wirtgen GmbH, Windhagen (DE)

(72) Inventors: Markus Bach, Bonn (DE); Christian Berning, Züplich (DE)

(73) Assignee: Wirtgen GmbH, Windhagen (DE)

( * ) Notice: Subject to any disclaimer, the term of this patent is extended or adjusted under 35 U.S.C. 154(b) by 60 days.

(21) Appl. No.: 17/982,680

(22) Filed: Nov. 8, 2022

(65) Prior Publication Data

US 2023/0151562 A1 May 18, 2023

(30) Foreign Application Priority Data

Nov. 12, 2021 (DE) ..... 10 2021 129 619.6

(51) Int. Cl.
*E01C 23/088* (2006.01)

(52) U.S. Cl.
CPC ..... *E01C 23/088* (2013.01)

(58) Field of Classification Search
CPC ..... E01C 23/088; E01C 23/127; B60L 1/00; B60L 1/003; B60K 1/04
See application file for complete search history.

(56) References Cited

U.S. PATENT DOCUMENTS 4,229,688 A * 10/1980 Knox ..... G01R 31/3646 323/902
4,998,775 A * 3/1991 Hollifield ..... B23D 59/002 451/450
5,743,247 A * 4/1998 Kingsley ..... B28D 1/045 404/94

(Continued)

FOREIGN PATENT DOCUMENTS

CN 102213174 A 10/2011
CN 105121108 A 12/2015

(Continued)

OTHER PUBLICATIONS

"Gear"—McGraw Hill's AccessScience https://www.accessscience.com/content/article/a283100 accessed Mar. 2025.*

(Continued)

*Primary Examiner* — Janine M Kreck

(74) *Attorney, Agent, or Firm* — Gary L. Montle; Lucian Wayne Beavers; Patterson Intellectual Property Law, PC

(57) ABSTRACT

A self-propelled earth working machine includes a machine frame and a traveling gear, the traveling gear including drive units rollable on a contact subsurface of the earth working machine, the machine frame supporting a working apparatus, the earth working machine having as a main functional unit a work drive in order to drive the working apparatus to perform a work movement for earth working, and the earth working machine having at least one further functional unit, the earth working machine having a common power source, which provides both the energy for the work drive as well as the energy for the further functional unit. The common power source includes a common electrical supply switching device, to which every functional unit is connected in electrically conductive fashion, wherein the main functional unit includes an electric motor.

17 Claims, 1 Drawing Sheet

(56) References Cited

U.S. PATENT DOCUMENTS

| | | | | |
|---|---|---|---|---|
| 7,053,568 | B2 * | 5/2006 | Rudinec | B60L 50/51 318/762 |
| 8,622,480 | B2 | 1/2014 | Weckerly et al. | |
| 8,660,724 | B2 | 2/2014 | Tarasinski et al. | |
| 9,379,542 | B2 * | 6/2016 | Lovercheck | B60L 15/2045 |
| 9,580,966 | B2 * | 2/2017 | Rudinec | E21B 7/025 |
| 10,000,897 | B2 | 6/2018 | Reuter et al. | |
| 10,724,188 | B2 | 7/2020 | Berning et al. | |
| 11,236,472 | B2 | 2/2022 | Mannebach et al. | |
| 2006/0076821 | A1 * | 4/2006 | Troudt | B28D 1/18 299/39.2 |
| 2011/0248110 | A1 | 10/2011 | Graner et al. | |
| 2011/0248654 | A1 * | 10/2011 | Graner | E02F 9/2025 318/152 |
| 2011/0255919 | A1 * | 10/2011 | Graner | E01C 23/088 404/90 |
| 2012/0027514 | A1 * | 2/2012 | Hall | E01C 23/065 404/90 |
| 2012/0027533 | A1 * | 2/2012 | Hall | E21C 27/24 409/235 |
| 2013/0048382 | A1 * | 2/2013 | Rudinec | E21B 7/025 175/57 |
| 2013/0082511 | A1 | 4/2013 | Weckerly et al. | |
| 2015/0091363 | A1 | 4/2015 | Reuter et al. | |
| 2017/0292649 | A1 * | 10/2017 | Lubischer | E21C 25/08 |
| 2018/0065621 | A1 * | 3/2018 | Merkle | B60L 50/15 |
| 2019/0118207 | A1 * | 4/2019 | Huerlimann | B05B 12/1436 |
| 2022/0185114 | A1 | 6/2022 | Bebeti et al. | |
| 2022/0389666 | A1 | 12/2022 | Farr et al. | |

FOREIGN PATENT DOCUMENTS

| | | | | |
|---|---|---|---|---|
| CN | 105682974 | A | 6/2016 | |
| CN | 207714099 | U | 8/2018 | |
| CN | 111794063 | A | 10/2020 | |
| CN | 112238792 | A | 1/2021 | |
| CN | 113580946 | A | 11/2021 | |
| CN | 219137338 | U | 6/2023 | |
| DE | 102004012767 | A1 | 10/2005 | |
| DE | 102012006189 | A1 | 10/2013 | |
| DE | 102012022732 | A1 * | 5/2014 | B62D 5/30 |
| DE | 112012004074 | T5 | 7/2014 | |
| DE | 102014011195 | A1 * | 1/2016 | E01C 23/088 |
| DE | 102016208242 | A1 | 11/2017 | |
| DE | 102017220518 | A1 | 11/2018 | |
| DE | 112019000005 | T5 | 8/2020 | |
| DE | 102019002439 | A1 | 10/2020 | |
| DE | 102019203731 | A1 | 10/2020 | |
| EP | 2519420 | A1 | 11/2012 | |
| JP | 2009097270 | A | 5/2009 | |
| JP | 2009215855 | A | 9/2009 | |
| KR | 101981686 | B1 | 5/2019 | |
| WO | 2020059164 | A1 | 3/2020 | |

OTHER PUBLICATIONS

Third Party Objection dated Nov. 14, 2023, filed in corresponding German Application DE 102021129619.6 (not prior art).

English machine translation of Party Objection dated Nov. 14, 2023 filed in corresponding German Application DE 102021129619.6 (not prior art).

Third Party Objection dated Nov. 29, 2023, filed in corresponding German Application DE 102021129619.6 (not prior art).

English machine translation of Party Objection dated Nov. 29, 2023 filed in corresponding German Application DE 102021129619.6 (not prior art).

"Hybride und energieeffiziente Antriebe fur mobile Arbeitsmaschinen", Feb. 15, 2017, (214 pages).

Google translation of "Hybride und energieeffiziente Antriebe fur mobile Arbeitsmaschinen", Feb. 15, 2017.

European Search Report for corresponding patent application 22206937.9 dated Apr. 5, 2023, 13 pages (not prior art).

Brochure for Kaltfrase W 350 E - URL:https://docplayer.org/47973589-Abgasfreie-kleinfraese-mit-elektrischem-antrieb- kaltfraese-w-350-e.html; dated May 2012 (2012-05-31).

Chinese opposition report, May 19, 2025, 14 pages.

Chinese Office Action, State Intellectual Property Office, for application No. 202211333188.2, dated Aug. 26, 2025, 11 pages.

* cited by examiner

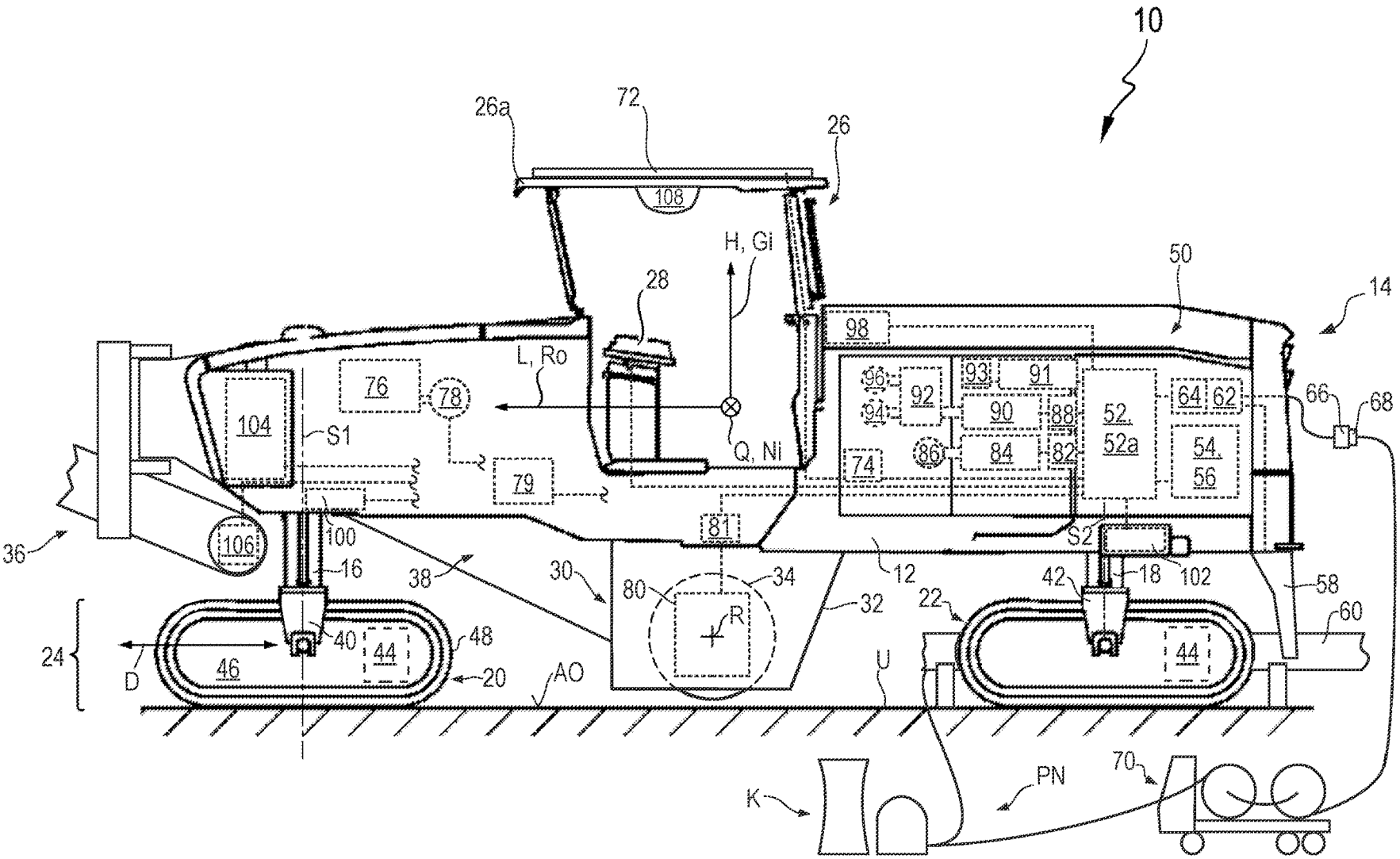
10
14
68
66
58
60
50
62
64
54
56
52
52a
102
18
44
70
S2
42
PN
91
88
82
93
90
84
92
86
96
94
74
98
22
12
U
32
26
H, Gi
Q, Ni
34
R
81
K
108
72
28
80
30
AO
L, Ro
79
26a
78
48
20
38
76
S1
100
16
40
44
104
106
46
D
36
24

PREDOMINANTLY ELECTRICALLY OPERATED EARTH WORKING MACHINE

BACKGROUND OF THE DISCLOSURE

Field of the Disclosure

The present application relates quite generally to a self-propelled earth working machine. The earth working machine comprises a machine frame and a traveling gear supporting the machine frame. The traveling gear comprises a plurality of drive units able to roll on a contact subsurface of the earth working machine. The machine frame supports a working apparatus for earth working. As a main functional unit, the earth working machine has a work drive, in order to drive the working apparatus to perform a work movement as intended for earth working. The earth working machine has at least one further functional unit as a consumer that is to be supplied with energy. The earth working machine has a common power source, which supplies both the energy for the work drive as well as the energy for the further functional unit.

Description of the Prior Art

Such an earth working machine is generally known. Examples for this are disclosed in DE 10 2017 220 518 A1 or also in DE 10 2016 208 242 A1.

In these known earth working machines, the aforementioned common power source is a combustion engine, which forms a kind of power plant of the earth working machine. The combustion engine directly provides the kinetic energy for the work drive via its output shaft by interposition of at least one gear unit, normally a belt gear and a planetary gear, between the output shaft and the working apparatus. The combustion engine also drives, normally also by interposition of a gear unit, a hydraulic pump, which delivers hydraulic oil in a hydraulic oil circuit and maintains it at an operational hydraulic pressure. The hydraulic pump therefore forms a further power source of the earth working machine. Since the hydraulic oil circuit obtains its energy content and thus its ability to perform physical work from the operation of the combustion engine, the hydraulic pump is a secondary power source, while the combustion engine is a primary power source of the known earth working machines.

The known combustion engine is likewise able, in a manner known per se, to drive a generator with its output shaft, which provides electrical energy for electrical consumers and electrical accumulators of the earth working machine. The generator thus also forms a secondary power source of the earth working machine.

So that a single combustion engine as the primary power source is able to drive multiple secondary power sources and the working apparatus, transfer gears are often used in earth working machines, an input shaft of the transfer gear being coupled to the output shaft of the combustion engine in movement-transmitting and torque-transmitting fashion and this input shaft being coupled via gear stages in the most general sense to a plurality of output shafts in movement-transmitting and torque-transmitting fashion, so that it is possible to tap kinetic energy output by the combustion engine at each of the output shafts.

Increasingly more stringent emission regulations are motivating the manufacturers of earth working machines consistently to reduce the emission of pollutants of the earth working machines.

SUMMARY OF THE DISCLOSURE

It is therefore an object of the present invention to develop an earth working machine of the kind mentioned at the outset with respect to reducing its emission of pollutants.

The present invention achieves this object in the earth working machine mentioned at the outset in that the common power source comprises a common electrical supply switching device, to which every functional unit of the main functional unit and the at least one further functional unit is connected in an electrically conductive manner for transmitting electrical energy between the supply switching device and the respective functional unit, the main functional unit comprising an electric motor for converting the electrical energy transmitted to the main functional unit into kinetic energy.

In place of the aforementioned combustion engine, the earth working machine thus comprises an electrical power source as the common power source of the multiple functional units. This electrical power source comprises an electrical circuit, which in the present application is referred to as a "supply switching device" in order to distinguish it from other electrical circuits provided in the earth working machine. The supply switching device is preferably designed to transmit electrical power of at least 75 kW, preferably of at least 95 kW.

In contrast to the combustion engine, which, for providing kinetic energy on its output shaft, normally burns fossil fuel and thus produces exhaust gases as pollutant emission, the provision of electrical energy at the supply switching device does not directly produce any emission of pollutants. The emission of exhaust gases in the surroundings of the earth working machine is thus substantially reduced in terms of quantity or even eliminated entirely.

Energized by the supply switching device, the main functional unit with the electric motor is thus able to drive the working apparatus to perform its working movement and thus to perform earth work. In a preferred application of the earth working machine as a road milling machine or as a recycler or as a surface miner, the working apparatus comprises a milling drum situated on the machine frame so as to be able to rotate about a milling drum axle. The working movement is then a rotation about the milling drum axle. In the usual working configuration, the milling axle runs preferably in parallel to the contact subsurface, on which the earth working machine stands, and particularly preferably in the transverse direction of the machine, that is, orthogonally both with respect to the longitudinal direction of the machine as well as to the vertical axis of the machine, although other orientations of the milling drum axle are also possible permanently or temporarily.

In the operational state of the earth working machine, the electric motor of the main functional unit may be surrounded entirely or partially by the milling drum tube of the milling drum. The electric motor of the main functional unit is then preferably a rotary electric motor, the axis of rotation of the rotor of the electric motor preferably being the milling drum axle. In order to achieve an advantageously low number of components of the drive train, the electric motor of the main functional unit preferably drives the working apparatus directly. For this purpose, the rotor of the electric motor is preferably connected in torque-transmitting fashion directly to the working apparatus. In this case, no change occurs in the rotational speed and the torque in the torque transmission path from the electric motor to the working apparatus. It shall not be precluded, however, that at least one gear unit is situated between the electric motor of the main functional unit and the working apparatus. In this case, depending on the number and/or type of the gear units situated between the electric motor and the working apparatus, the axis of rotation of the rotor may run in parallel or even at an angle with respect to the milling drum axle. The axis of rotation of the rotor of the electric motor of the main functional unit may therefore even run in inclined fashion with respect to the axis of the rotation of the working apparatus, in particular of the milling drum.

The main functional unit may also comprise a plurality of electric motors for driving the working apparatus. Combined via a summing gear, the several electric motors are able to output torque to a common output shaft.

The electric motor of the main functional unit may be a direct current motor or an alternating current motor. As the latter, a synchronous motor is preferred over an asynchronous motor because it is free of slip. In principle, however, any type of electric motor may be used.

For supplying at least two different functional units, namely, the main functional unit and the further functional unit, with electrical energy, the common electrical supply switching device may comprise a direct current intermediate circuit or be such a direct current intermediate circuit. This has the advantage that direct current energy stores proven in self-propelled working machines may be used directly and be connected to the direct current intermediate circuit. Likewise, direct current consumers proven in self-propelled machines may be used. A direct current energy store corresponds in its function in relation to the supply switching device to the fuel tank of an earth working machine in relation to the combustion engine. A further advantage in addition to the absence of emissions is that the direct current energy store, in contrast to the fuel tank, is able to output its stored energy without conversion through combustion and piston actuation more efficiently from the supply switching device and thus from the common power source to the plurality of functional units.

Not all functional units connected to the supply switching device normally required electrical energy in the same form of delivery or manifestation. It is also possible that not all, possible even none, of the functional units connected to the supply switching device require or are able to use electrical energy in the form in which an energy source, for example the aforementioned DC voltage energy store, connected to the supply switching device, outputs it to the supply switching device.

In order to make the electrical energy that can be tapped at the supply switching device usable for various functional units, a power circuit may be interconnected between at least one functional unit of the main functional unit and the at least one further functional unit on the one hand and the common electrical supply switching device on the other hand. The power circuit may be developed to change, in terms of magnitude, at least one parameter, which characterizes, in terms of magnitude, the electrical energy input by the supply switching device into the power circuit, and to output the electrical energy thus modified to the functional unit. The power circuit may in particular include one or multiple converters.

The power circuit may comprise for example a DC voltage converter, which transforms a DC voltage of the supply switching device into a DC voltage that differs in terms of magnitude. The parameter characterizing the electrical energy of the supply switching device in terms of magnitude is then the DC voltage value, for example. Additionally or alternatively, the power circuit may comprise an inverter. The latter converts a DC voltage of the supply switching device into an AC voltage. The characterizing parameter may then be for example the frequency and/or the amplitude of the AC voltage. The supply switching device is thus able to supply electrical energy both to functional units operated with DC voltage as well as to functional units operated with AC voltage. These embodiments of the power circuit are above all applicable if the supply switching device comprises the aforementioned direct current intermediate circuit.

The inverter may be designed to convert an input direct current into an output alternating current having a variable frequency, for example by a thyristor circuit or the like, so that the inverter allows for a power output of alternating current motors, in particular synchronous motors, by changing the frequency of the alternating current supplied to the alternating current motor.

In principle, it shall not be precluded that the supply switching device directly outputs an AC voltage, although this is unusual for self-propelled working machines. In this case, the mentioned power circuit may comprise a rectifier, in order to be able to use the supply switching device also to operate functional units that are to be supplied with DC voltage.

While the main functional unit always provides the work drive of the working apparatus as the primary purpose of the earth working machine, the at least one further functional unit may fulfill various functions. For example, the at least one further functional unit may comprise a kinetic functional unit, which converts the electrical energy supplied to it into kinetic energy. Such a kinetic functional unit may be any functional unit in the earth working machine, which performs a movement as intended relative to the machine frame of the earth working machine as a stationary reference system of the earth working machine. The main functional unit is accordingly always a kinetic functional unit.

Additionally or alternatively, the at least one further functional unit may comprise an operational functional unit, which supplies the electrical energy entered into it to a static consumer. "Static" means in this context that, relative to the machine frame, the consumer does not perform a movement caused by energy from the supply switching device during and within the scope of its normal operation. It shall not be precluded, however, that the static consumer is situated in a housing that is manually movable by an operator or situated on a manually movable carrier, in order to be positioned by the operator, for example according to ergonomic considerations. Such a static consumer or such an operational functional unit may be a display device, a data processing device or a luminous device, for example a display screen situated at a control panel. It may be possible to position and orient the display screen manually. If it is possible to position and/or orient the display screen by motor, then the display screen remains an operational functional unit in the sense of the present application. By contrast, the actuator used to position and/or orient the display screen is a kinetic functional unit in the above sense. The same is true of all functional units, whose normal operation does not comprise movement, but which themselves in turn are movable and/or orientable by a kinetic functional unit.

Hence, the at least one further functional unit may comprise at least one unit of a) a propulsion drive for driving the earth working machine to perform a driving movement on the contact subsurface, b) a ventilator drive for driving a ventilator situated on the earth working machine into motion, c) a pump drive for driving a pump for conveying a fluid, d) a conveyor device drive for driving a conveyor device for the conveying operation, e) an actuating drive for changing a relative position of a functional unit relative to the machine frame, f) an steering drive for changing the steering angle of at least one drive unit relative to the machine frame, g) a vehicle electrical system, h) an electrical illumination and/or electrical signaling system of the earth working machine, and i) an electrical control device.

The units mentioned in list items a) through f) in the above non-exhaustive list are kinetic functional units. The units of the list items g) through i) are operational functional units in the sense of the present invention.

For example, in addition or as an alternative to the currently customarily used hydraulic drives (so-called "hydraulic motors"), the propulsion drive may have electric motors, which drive wheels or tracks as possible rollable drive units of the earth working machine to perform a rotation or circulating movement. The electric motors are preferably rotary electric motors, while linear motors shall not be precluded. The ventilator drive may also have an electric motor, which drives the ventilator or impeller respectively coupled for movement transmission to the output shaft of the electric motor to rotate. The electric motor of a ventilator drive is preferably also a rotary electric motor.

The pump drive may be a drive of any pump, in particular fluid pump, for example a hydraulic pump for conveying, in particular circulating, hydraulic oil, an oil pump for conveying, in particular circulating, lubricating oil, a coolant pump for conveying, in particular circulating, coolant, particularly preferably between a device to be cooled and a heat exchanger, and the like. For the supply of electrical energy by the supply switching device, the pump drive may have an electric motor, preferably a rotary electric motor, while a linear electric motor shall not be precluded in addition or as an alternative.

The conveyor device of the earth working machine may be any conveyor device such as, for example, at least one conveyor belt as known per se. Other conveyor devices shall not be precluded, however, such as, for example, a screw conveyor in a conveyor tube or a blower conveyor. The latter is used for example for vacuuming dust on the earth working machine. The conveyor device drive may comprise a linear and/or, and this is preferred, a rotary electric motor.

The actuating drive was already explained above in the example of positioning and/or orienting a display screen. The same applies for a possible actuating drive of a driver's seat, a displaceable protective canopy of the operator's platform of the earth working machine, a shutter or hood and the like that are opened and or closed by actuator. The actuating drive may also comprise a linear and/or rotary electric motor.

A special form of the actuating drive is the steering drive, which provides for the rotation of a drive unit about a steering axis. The steering drive may also comprise a linear and/or rotary electric motor.

All of the aforementioned drives may be coupled to the associated device for transmitting force and/or torque and movement via an interposed gear unit and/or linkage.

Of course, the earth working machine may have at least one functional unit, which is not supplied with energy by the supply switching device either directly or indirectly. Preferably, however, the supply switching device is the direct or indirect energy supplier for all functional units of the earth working machine.

Likewise, at least one or several of the aforementioned drives may be fluidic drives such as, for example, a hydraulic piston-cylinder system and/or a pneumatic piston-cylinder system. Such a fluidic drive may be arranged for lifting and lowering the machine frame relative to the drive units. The drives may then have switchable valves electrically suppliable by the supply switching device. The drives may furthermore comprise the aforementioned pump drive, which generates and provides sufficient hydraulic and/or pneumatic pressure for operating the fluidic drives. In place of a fluidic lift drive for displacing the machine frame relative to the drive units, an electric lift drive, for example a linear drive or a rotary drive with a gear unit, may also be arranged for this purpose.

The aforementioned vehicle electrical system as an operational functional unit may provide a basic supply of electrical consumers of the earth working machine with a predetermined electric voltage. Further electrical consumers may be connected to this vehicle electrical system. An electrical illumination, such as, for example, headlights, tail lights or an illumination of the operator's platform, of the earth working machine and/or an electrical signal system of the earth working machine including warning lights and/or brake lights, blinkers and the like may be connected either to the vehicle electrical system or directly to the supply switching device. The same applies for the at least one aforementioned electrical control device, which preferably comprises at least one integrated circuit and/or a data storage unit.

If the at least one further functional unit comprises at least one pump drive, the at least one pump drive may have at least one of the following embodiments: an electric motor drives a plurality of pumps by interposition of a pump transfer gear, and an electric motor drives, possibly by interposition of a gear, preferably a speed step-down gear, exactly one pump. There may thus exist a 1:1 correlation between an electric motor and a pump or a 1:n correlation between an electric motor and a plurality of pumps. It may furthermore be provided that one portion of existing pumps respectively has a separate electric motor as the drive, and another portion of existing pumps is driven by a common electric motor.

A particularly advantageous and simple control of a pumping capacity may be obtained in that at least one driven pump is a constant displacement pump, the output volume and/or delivery pressure of which is variable by varying the rotational speed of the pump. Thus, by changing the rotational speed of the electric motor driving the pump, it is possible to change the pumping capacity directly in a targeted manner. Alternatively, the use of variable delivery pumps is also conceivable.

Apart from their standstill torque at a rotational speed of zero, one advantage of electric drives is that they can be used not only motorically for acceleration, but also in generator mode for decelerating an assembly coupled to them for joint movement. So as not merely to dissipate the reduced kinetic energy as heat into the surroundings when decelerating a kinetic functional unit, but rather to be able to use again at least a portion of it for subsequent acceleration processes, a development of the present invention provides for the common power source with the common electrical supply switching device to be designed to recuperate kinetic energy of the kinetic functional unit as electrical energy during a deceleration process of a kinetic functional unit connected to the supply switching device in electrically conductive fashion. This applies in particular for a recuperation of electrical energy from a movement of the working apparatus using the main functional unit which is then operated in generator mode. Incidentally, the work against effects of friction of a kinetic functional unit for achieving an operation at a constant rotational speed also counts as an acceleration in the present context. In this case too, the electric motor outputs an accelerating torque, which compensates for merely decelerating friction losses.

For supplying the functional units with power, the common power source comprises a primary energy source. The primary energy source is connected in electrically conductive fashion to the common supply switching device, optionally directly, i.e. without the interposition of further converter devices converting the primary energy according to type and/or quantity. The primary energy source may comprise at least one source unit. Such a source unit may be an accumulator, that is, a rechargeable electrical direct current energy store. The accumulator, which colloquially is often referred to in vehicles as a "battery", may comprise a charging circuit, which controls charging the accumulator with electrical energy. Such a charging circuit is advantageous especially for an aforementioned recuperation operation, in order periodically to supply electrical energy to the accumulator and periodically to draw electrical energy from the accumulator.

A further possible source unit is a battery, that is, an electrical direct current energy store. The latter is not necessarily rechargeable.

The primary energy source may also comprise a generator as a source unit, for example in the shape of a converter, which converts movement into electrical energy in a functional reversal of an electric motor. The generator may output direct current or alternating current. Preferably, the generator in self-propelled vehicles will generate and output customary direct current.

A further possible source unit is a fuel cell system, which as a galvanic cell converts the chemical reaction energy of a, preferably continuously, supplied fuel and a, preferably continuously, supplied oxidizing agent into electrical energy. Additionally or alternatively, the primary energy source may have a photovoltaic unit, which converts incident light into electrical energy. The primary energy source may also comprise a current collector, which is connected in electrically conductive fashion to an energy source for electrical energy situated outside of the earth working machine. The current collector may be, for example, a sliding contact that is movable jointly with the machine frame of the earth working machine relative to the contact subsurface of the earth working machine, which sliding contact abuts in sliding fashion against a source conductor such as a wire conductor or a conductor rail installed outside of the earth working machine essentially in a stationary manner, i.e., normally fixed on the contact subsurface.

Additionally or alternatively, the primary energy source may generally comprise a connection interface for connecting to an external current source. The aforementioned current collector is a special form of a connection interface for connecting to an external current source. In addition or as an alternative to a mechanical or physical sliding contact, electrical energy may also be transmitted at the connection interface inductively and thus in contactless fashion. The connection interface may also comprise a simple socket-plug connection, that is, a plug socket and/or a plug, whereby a cable-based current-carrying connection may be established. The current-carrying cable may be unwound from and rewound onto a winding drum as a function of the movement of the earth working machine. The winding drum of the cable may be connected to the machine frame and be carried along with the earth working machine or it may be stationary outside of the earth working machine. It is also possible for the winding drum of the cable to be accommodated on an escort vehicle of the earth working machine while the earth working machine is in operation. The winding drum is then not provided on the earth working machine, but rather outside of the earth working machine, yet not in a stationary manner.

To ensure a redundant energy supply, which makes it possible to absorb a failure of the primary energy source and thus an operating failure of the earth working machine, the common power source may comprise at least one secondary energy source in addition to the primary energy source. This secondary energy source is preferably connected in electrically conductive fashion to the common electrical supply switching device. Alternatively, it is also conceivable merely to carry the secondary energy source along on the earth working machine without connection to the supply switching device and to connect it to the supply switching device only as necessary. What was said above regarding the primary energy source also applies to the secondary energy source. The secondary energy source may comprise one or several of the source units mentioned above for the primary energy source.

Furthermore, it is conceivable that at least one source of primary energy source and secondary energy source is designed and situated, preferably also, for charging an electrical energy store. The electrical energy store may be a primary energy source chargeable by a secondary energy source or a secondary energy source chargeable by the primary energy source and/or by a further secondary energy source.

It is possible for a supply circuit to be connected between at least one energy source of primary energy source and secondary energy source or between at least one source unit of the primary energy source and/or the secondary energy source on the one hand and the common electrical supply switching device on the other hand. This supply circuit is able to convert the electrical energy provided directly by the at least one source unit or by the at least one energy source of primary energy source and secondary energy source into a form usable for the functional units or for the supply switching device. For this purpose, the supply circuit is preferably designed to change, in terms of magnitude, at least one parameter, which characterizes, in terms of magnitude, the electrical energy input by the energy source into the supply circuit, such as the provided voltage, the provided frequency in the case of alternating current, and the like, and to output the electrical energy thus modified to the common electrical supply switching device. The supply circuit may include in particular a converter.

For example, the supply circuit may comprise at least one device of the following: a rectifier, which converts AC voltage into DC voltage, and a DC voltage converter, which changes a provided DC voltage in terms of magnitude, that is, increasing or reducing it.

If the earth working machine is connected to an alternating current source, which normally provides an electrical AC voltage of a fixed frequency, then a rectifier as supply circuit, a direct current intermediate circuit and an inverter having a variably settable output frequency can advantageously form a frequency converter, by which alternating current of a fixed input frequency can be converted into a current of variable frequency output to a consumer. This makes it possible that, in spite of sourcing a current of fixed frequency, an electric motor as the consumer can be influenced in its power output and thus controlled by changing the frequency of the current supplied to it.

In principle, the earth working machine may include a combustion engine for operating an on-board generator. The nominal operating power of the combustion engine preferably comprises no more than 50% of the nominal total operating power of the earth working machine, in particular of the supply switching device, in order to ensure that the exhaust-gas emission emanating from the earth working machine does not exceed a predetermined limit value. This also makes it possible to ensure that the exhaust-gas emission emanating from the earth working machine is considerably lower than that of the earth working machines common at the time of the application, in which a combustion engine is the central power source for the entire earth working machine. Preferably, the earth working machine is free of a combustion engine. In this context, a combustion engine is any power machine that by combusting fuels converts the inner energy of the fuels into kinetic energy with the acceptance of usual losses.

BRIEF DESCRIPTION OF THE DRAWING

The present invention will be explained in greater detail below with reference to the attached drawings. The figures show:

FIG. 1 a rough schematic side view of an earth working machine according to the invention in the exemplary form of a large road milling machine.

DETAILED DESCRIPTION

In FIG. 1, a specific embodiment according to the invention of an earth working machine in the form of an earth or road milling machine is generally indicated by reference numeral 10. It comprises a machine frame 12, which forms the basic framework for a machine body 14. Machine body 14 comprises machine frame 12 and the components of machine 10 which are connected to the machine frame and are, if indicated, movable relative thereto.

Machine body 14 comprises front lifting columns 16 and rear lifting columns 18, which are connected at one end to machine frame 12 and at the other end respectively to front drive units 20 and to rear drive units 22. The distance of machine frame 12 from drive units 20 and 22 is modifiable by way of lifting columns 16 and 18.

Drive units 20 and 22 are depicted by way of example as crawler track units. In a departure therefrom, individual, or all, drive units 20 and/or 22 may also be wheel drive units.

The viewer of FIG. 1 looks onto the earth working machine or simply "machine" 10 in a direction of view that is parallel to the transverse direction Q of the machine, which is orthogonal to the drawing plane of FIG. 1. A longitudinal machine direction orthogonal to transverse machine direction Q is labeled L and extends parallel to the drawing plane of FIG. 1. A vertical machine direction H likewise extends in parallel to the drawing plane of FIG. 1 and orthogonally to longitudinal machine direction L and transverse machine direction Q. The arrowhead of longitudinal machine direction L in FIG. 1 points in the forward direction. Vertical machine direction H extends in parallel to the yaw axis Gi of machine 10, longitudinal machine direction L extends in parallel to the roll axis Ro, and transverse machine direction Q extends in parallel to pitch axis Ni.

The earth working machine 10 may comprise an operator's platform 26, from which a machine operator is able to control machine 10 via a control panel 28 as a control device of the machine 10.

Arranged below machine frame 12 is a working assembly 30, here represented, by way of example, as a milling assembly 30 having a milling drum 34, accommodated in a milling drum housing 32, that is rotatable about a milling axis R extending in the transverse machine direction Q so that substrate material may be removed therewith during an earth working operation, starting from contact surface AO of the contact subsurface, or simply "subsurface" U, to a milling depth determined by the relative vertical position of machine frame 12. The milling drum 34 is therefore a working apparatus within the meaning of the present application. The contact subsurface U may also be referred to as ground surface U on which the wheels or tracks roll.

In the illustrated machine, the vertical adjustability of machine frame 12 by way of lifting columns 16 and 18 also serves to set the milling depth, or generally working depth, of machine 10 or the milling assembly 30 in the context of earth working. The earth working machine 10 depicted by way of example is a large milling machine, for which the placement of milling assembly 30 between and at a distance from the front and rear drive units 20 and 22 in the longitudinal machine direction L is typical. Large milling machines of this kind, or indeed earth-removing machines in general, usually comprise a transport device so that removed earth material can be transported away from machine 10. Of a transport device fundamentally present in machine 10, for reasons of better clarity, FIG. 1 only shows partially a discharge belt 36 with its end region located closer to the machine frame 12. The discharge belt 36 is loaded by a transfer belt, not shown in FIG. 1 but situated in region 38, with removed earth material, which the discharge belt 36 in the machine 10, designed as a front loader machine, transfers to a transport vehicle, driving ahead of the machine, which is likewise not illustrated in FIG. 1.

It is not apparent from the lateral view of FIG. 1 that machine 10 comprises, in both its front end region and its rear end region, two respective lifting columns 16 and 18 each having a drive unit 20, 22 connected to it. Front lifting columns 16 are respectively connected to drive units 20, in a manner also known per se, by a drive unit connecting structure 40, for example a connecting fork fitting around drive unit 20 in transverse machine direction Q. Rear lifting columns 18 are connected to their respective drive unit 22 via a rear drive unit connecting structure 42 constructed identically to the front drive unit connecting structure 40. Drive units 20 and 22 are of substantially identical construction and constitute traveling gear 24 of the machine. In the illustrated example, the drive units 20 and 22 are driven electromotively, namely, by one electric motor 44 per drive unit 20 and 22.

In the illustrated example, the drive unit 20, having a travel direction indicated by double arrow D, comprises a radially inner accommodation and guidance structure 46, which supports the electric motor associated with drive unit 20 and on which a circulating drive track 48 is arranged and is guided for circulating movement. The same applies analogously to drive unit 22.

Lifting column 16 and with it drive unit 20 are rotatable about a steering axis S1 by way of a steering apparatus (not illustrated further). Preferably additionally, but also alternatively, lifting column 18, and with it drive unit 22, may be rotatable by way of a steering apparatus about a steering axis S2 parallel to steering axis S1.

The machine comprises a power source 50, which represents a central energy supply of machine 10. At least, the power source 50 supplies multiple functional units of the machine 10 with energy, namely, directly with electrical energy.

The power source 50 comprises a supply switching device 52 accommodated on the machine frame 12. The supply switching device 52 is in the present case designed as a direct current intermediate circuit 52*a*.

In the illustrated exemplary embodiment, the supply switching device 52 receives electrical energy from a plurality of electrical energy sources. As an on-board energy source, for example as primary energy source 54, machine 10 carries along an accumulator 56, which supplies the supply switching device 52 with direct current. The rechargeable accumulator 56 is able to output the electrical energy stored within it directly to the supply switching device 52, since the output DC voltage of the accumulator 56 matches the operating DC voltage of the supply switching device 52. If this is not the case, a DC voltage converter may be situated between the accumulator 56 and the supply switching device 52.

In addition to the accumulator 56, the machine 10 has a plurality of secondary energy sources for the explanatory purposes. The division into primary and secondary energy sources is merely by way of example and may deviate from the presently illustrated example. Nevertheless, the assumption of a powerful accumulator 56 as primary energy source 54 of machine 10 is practical.

As a first secondary energy source, machine 10 and in particular the power source 50 may comprises a current collector 58, which taps alternating current from a current rail 60, which is supplied by a public power network PN fed by a power station K.

The current collector 58 is connected directly to a rectifier 62, which converts the tapped alternating current of the public power network into a DC voltage that is usable for the supply switching device 52. The rectifier 62 may be connected to a DC voltage converter 64, which converts the DC voltage output by the rectifier 62 to the DC voltage level of the supply switching device 52.

A further secondary energy source is a cable-bound plug connection 66, for example in the form of a plug socket, which may likewise be connected to the public power network PN via a matching counterpart 68, for example a plug. Since alternating current is thus obtained also via the plug connection 66, yet the supply switching device 52 requires DC voltage, the plug connection 66 is also connected to the rectifier 62 and to the DC voltage converter.

In order to provide the machine 10 with a sufficient range of movement in spite of the cable connection to the public power network PN, the cable connection of machine 10 to the public power network PN may be established via a cable winding drum vehicle 70, which accompanies the machine 10 in operation.

A further secondary energy source may be a photo-voltaic panel 72, which is situated for example on the outer side of the protective roof 26*a* of the operator's platform 26. Since such photo-voltaic panels 72 normally output a DC voltage, the photo-voltaic panel 72 is connected in electrically conductive fashion by interposition of a DC voltage converter 74 to the supply switching device 52.

In order to be able to generate electrical energy for operating the machine 10 autonomously, if necessary, the machine 10 includes a combustion engine 76 as a further secondary energy source, which is able to drive a generator 78 via its output shaft. The generator 78 is connected in electrically conductive fashion to the supply switching device 52 via a suitable power circuit, so that generator 78 supplies electrical energy to the supply switching device 52 in the appropriate form and at the appropriate voltage level.

The earth working machine 10 may also comprise a fuel cell system 79 as an alternative or additional secondary energy source, which supplies the electrical energy it generates to the supply switching device 52, if necessary, via a suitable power circuit.

On the output side, the supply switching device 52 provides DC voltage or direct current to a plurality of functional units. The main functional unit of the earth working machine 10 is an electric motor 80, which forms the rotary drive of the milling drum 34. A gear unit may be situated between the electric motor 80 and the milling drum 34. However, the electric motor 80 may also drive the milling drum 34 directly to perform the rotary motion. A power circuit 81, for example a DC voltage converter and/or an inverter, may also be situated between the supply switching device 52 and the electric motor 80, in order to bring the electrical energy output by the supply switching device 52 into a form of energy suitable for the electric motor 80 in terms of magnitude and/or form. Such a supply circuit may comprise a DC voltage converter and/or an inverter. For the present exemplary embodiment, however, the electric motor 80 shall be assumed to be a direct current motor suppliable directly by the supply switching device 52. Alternatively or additionally, the electric motor 80 may have an integrated power control, by which the motor power of the electric motor 80 may be changed in targeted fashion, for example by the use of control commands of the control panel 28.

Apart from the electric motor 80 as the main functional unit, the supply switching device 52 supplies numerous further functional units.

Thus, in the exemplary embodiment, by interconnection of an inverter 82, the supply switching device 52 supplies a synchronous motor 84, which directly drives a constant displacement pump 86 of a hydraulic circuit. The constant displacement pump 86, the output volume of which is directly controllable via its rotational speed, provides a pressure level in the hydraulic oil circuit, which allows for the operation of hydraulic power devices on machine 10, such as the lifting columns 16 and 18 for example.

As a further functional unit, the supply switching device 52 by interconnection of a DC voltage converter 88 supplies a direct current motor 90, which drives, by way of a pump transfer gear 92, a first pump 94 for conveying liquid cooling medium and a second pump 96 for conveying a further liquid medium, for example a refrigeration circuit medium of an air conditioning system.

A direct current ventilator motor 91 supplied directly with direct current by the supply switching device 52 drives a ventilator 93 in order to cool by convection at least one liquid medium, for example the refrigeration circuit medium, the cooling medium, the hydraulic oil or lubricating oil conveyed by a pump (not shown).

As further functional units, the supply switching device 52 furthermore supplies electrical direct current to an electric actuating drive 98 for adjusting the protective roof 26*a* of the operator's platform 26 between the operating position shown in FIG. 1 and a lowered stowage position, as well as to a front electric steering drive 100 and a rear electric steering drive 102. As further functional units, the supply switching device 52 likewise supplies direct current to an electric swivel drive 104 of the discharge belt 36 as a conveyor device of the machine 10 and the rotating drive 106 of the discharge belt for revolving motion of the belt.

Finally, the supply switching device 52 supplies direct current to the control panel 28 and to an illumination device 108 of the operator's platform 26. The illumination device 108 may be supplied with direct current by interconnection of a vehicle electrical system, so that the supply switching device 52 supplies a vehicle electrical system with a predetermined DC voltage, say, 24 V, for example after transforming the direct current using a DC voltage converter, the illumination device 108 or also the control panel 28 with its equipment for storing and processing data in turn being connected to the vehicle electrical system.

Thus, it is possible to operate the earth working machine 10 in fully electric fashion. In order to provide electrical energy at the earth working machine 10 as quickly as possible, the accumulator 56 may be connected to the supply switching device 52 by quick connectors that can be disconnected and reconnected quickly and may be connected to the machine frame 12 by quick-change fasteners that can be disconnected and reconnected quickly, so that a discharged accumulator, if sufficient time for charging it is not available, may be exchanged quickly for another, charged accumulator, if necessary.

The electric motors provided on the earth working machine 10 are capable of being operated as generators, so that in the event of decelerations at the devices driven by the respective electric motors, the kinetic energy reduced at the devices can be recuperated and be supplied to the accumulator 56 by the supply switching device 52 and be stored there.

The invention claimed is:

1. A self-propelled earth working machine, comprising:

a machine frame;

a plurality of wheels or tracks rollable on a ground surface for supporting the machine frame therefrom;

a working apparatus supported from the machine frame;

a primary direct current power source;

at least one secondary energy source;

a direct current intermediate circuit coupled to receive direct current (DC) power from the primary direct current power source and from the at least one secondary energy source;

wherein each of the primary direct current power source and the at least one secondary energy source are configured to provide a respective electrical energy input to the direct current intermediate circuit directly, or via a respective supply circuit configured to change a magnitude of at least one parameter characterizing the respective electrical energy input into the supply circuit and to output the electrical energy thus modified to the direct current intermediate circuit, wherein each input to the direct current intermediate circuit matches a specified DC operating value for the direct current intermediate circuit;

wherein each of a first functional unit and at least one further functional unit are connected in electrically conductive fashion for transmitting electrical energy between the direct current intermediate circuit and the first functional unit and the at least one further functional unit, directly or via a respective power circuit configured to change a magnitude of at least one parameter characterizing DC power received from the direct current intermediate circuit and to output electrical energy thus modified to the first functional unit and/or the at least one further functional unit, wherein each input to the first functional unit and the at least one further functional unit matches a specified operating value for the respective functional unit; and wherein the first functional unit includes an electric motor for converting electrical energy transmitted to the first functional unit into kinetic energy to drive the working apparatus for earth working.

2. The self-propelled earth working machine of claim 1, wherein:

the power circuit includes a DC voltage converter and/or an inverter.

3. The self-propelled earth working machine of claim 1, wherein:

the at least one further functional unit is configured to convert the electrical energy supplied thereto into kinetic energy.

4. The self-propelled earth working machine of claim 1, wherein:

the at least one further functional unit is configured to supply the electrical energy supplied thereto to a static consumer.

5. The self-propelled earth working machine of claim 1, wherein the at least one further functional unit is selected from the group consisting of:

a propulsion drive for driving the earth working machine to perform a driving movement on the ground surface;

a ventilator drive for driving a ventilator situated on the earth working machine;

a pump drive for driving at least one pump for conveying a fluid;

a conveyor drive for driving a conveyor;

an actuating drive for changing a relative position of a functional unit of the at least one further functional unit relative to the machine frame;

a steering drive for changing a steering angle of at least one drive unit relative to the machine frame;

a vehicle electrical system;

an electrical illumination system of the earth working machine;

an electrical signaling system of the earth working machine; and an electrical control device.

6. The self-propelled earth working machine of claim 5, wherein the at least one further functional unit comprises at least one pump drive, wherein an electric motor drives a plurality of pumps by interposition of a pump transfer gear.

7. The self-propelled earth working machine of claim 6, wherein at least one driven pump is a constant displacement pump, the output volume and/or delivery pressure of which is changeable by changing the rotational speed of the pump.

8. The self-propelled earth working machine of claim 5, wherein the at least one further functional unit comprises at least one pump drive, wherein an electric motor drives exactly one pump by interposition of a gear.

9. The self-propelled earth working machine of claim 8, wherein the pump is a constant displacement pump, the output volume and/or delivery pressure of which is changeable by changing the rotational speed of the pump.

10. The self-propelled earth working machine of claim 1, wherein a common power source comprising the direct current intermediate circuit is configured to recuperate, during a deceleration of a kinetic functional unit as at least one of the first functional unit and the at least one further functional unit, connected in electrically conductive fashion to the direct current intermediate circuit, kinetic energy of the kinetic functional unit as electrical energy.

11. The self-propelled earth working machine of claim 1, the primary energy source comprising at least one of the following source units: an accumulator; a battery; a generator; a fuel cell system; a photovoltaic unit; a current collector; and a connection interface for connecting to an external current source.

12. The self-propelled earth working machine of claim 11, the at least one secondary energy source comprising at least one of the following source units: an accumulator; a battery; a generator; a fuel cell system; a photovoltaic unit; a current collector; and a connection interface for connecting to an external current source.

13. The self-propelled earth working machine of claim 1, wherein the supply circuit comprises at least one of a rectifier and a DC voltage converter.

14. The self-propelled earth working machine of claim 1, wherein the earth working machine has a combustion engine for operating an on-board generator, a power of the combustion engine not exceeding fifty percent (50%) of a nominal total operating power of the earth working machine.

15. The self-propelled earth working machine of claim 14, wherein the power of the combustion engine is configured not to exceed fifty percent (50%) of a nominal total operating power of the direct current intermediate circuit.

16. The self-propelled earth working machine of claim 1, wherein the earth working machine is free of a combustion engine.

17. The self-propelled earth working machine of claim 1, wherein the working apparatus comprises a milling drum having a milling drum tube, wherein the electric motor of the first functional unit is at least partially surrounded by the milling drum tube, and wherein an axis of rotation of a rotor of the electric motor corresponds to an axle of the milling drum.

* * * * *